US007354007B2

(12) United States Patent
Pearson

(10) Patent No.: US 7,354,007 B2
(45) Date of Patent: Apr. 8, 2008

(54) THERAPEUTIC TRAINING STRAW

(75) Inventor: Calvin M. Pearson, Chesapeake, VA (US)

(73) Assignee: MCRT, LLC, Hampton, VA (US)

( * ) Notice: Subject to any disclaimer, the term of this patent is extended or adjusted under 35 U.S.C. 154(b) by 0 days.

(21) Appl. No.: 11/202,027

(22) Filed: Aug. 12, 2005

(65) Prior Publication Data

US 2007/0034708 A1 Feb. 15, 2007

(51) Int. Cl.

| | |
|---|---|
| ***A47G 21/18*** | (2006.01) |
| ***A61J 15/00*** | (2006.01) |
| ***B05B 17/04*** | (2006.01) |
| ***B05B 1/30*** | (2006.01) |

(52) U.S. Cl. ..... 239/33; 239/12; 239/571; 239/570

(58) Field of Classification Search ..... 239/33, 239/12, 571, 570, 16, 24, 569; 128/202.15; 222/158; 220/705–710; 604/77
See application file for complete search history.

(56) References Cited

U.S. PATENT DOCUMENTS

| | | | | |
|---|---|---|---|---|
| 1,813,285 | A * | 7/1931 | Galetschky | 239/33 |
| 3,957,202 | A | 5/1976 | Hornsby, Jr. | |
| D243,817 | S | 3/1977 | Cloyd | |
| 4,196,747 | A * | 4/1980 | Quigley et al. | 137/527.8 |
| 4,211,024 | A | 7/1980 | Nickell | |
| D262,176 | S | 12/1981 | Kamin et al. | |
| 4,825,897 | A * | 5/1989 | Shade | 137/271 |
| 4,971,048 | A * | 11/1990 | Seekins | 128/202.15 |
| 5,021,019 | A * | 6/1991 | Gandy | 472/52 |
| 5,044,512 | A * | 9/1991 | Giancaspro et al. | 220/709 |
| 5,057,077 | A * | 10/1991 | Turner et al. | 604/77 |
| D329,958 | S | 10/1992 | McNerney et al. | |
| D329,959 | S | 10/1992 | McNerney et al. | |
| D330,141 | S | 10/1992 | McNerney et al. | |
| D330,142 | S | 10/1992 | McNerney et al. | |
| D330,143 | S | 10/1992 | McNerney et al. | |
| 5,160,087 | A | 11/1992 | Mandell | |
| D331,348 | S | 12/1992 | Park | |
| D332,198 | S | 1/1993 | Goodman, Jr. | |
| D333,940 | S | 3/1993 | McNerney et al. | |
| 5,222,940 | A * | 6/1993 | Wilk | 604/77 |
| 5,339,982 | A | 8/1994 | Tardie | |
| 5,427,315 | A | 6/1995 | Lipson | |
| 5,439,125 | A | 8/1995 | Bloch | |
| 5,449,494 | A * | 9/1995 | Seeney | 422/100 |
| 5,584,434 | A | 12/1996 | Lipson | |

(Continued)

*Primary Examiner*—Darren Gorman
(74) *Attorney, Agent, or Firm*—Bingham McCutchen LLP

(57) ABSTRACT

A drinking straw for controlling the intake of beverages, comprising an elongated hollow member having at least two open ends, at least one end being a suction end adapted for application of a suction force, and at least one end being a liquid end adapted for immersion in a liquid beverage; at least one compartment associated with each at least one suction end and located between the associated at least one suction end and the at least one liquid end and having openings for communicating the liquid beverage therethrough; and at least one insoluble object within the at least one compartment having an outer circumference smaller than an inner circumference of the at least one compartment; wherein the compartment openings and the object are dimensioned to prevent escape of the object from the compartment; and wherein the at least one object seals at least one compartment opening subsequent to the application of the suction force to prevent the movement of the liquid beverage past the opening.

27 Claims, 5 Drawing Sheets

U.S. PATENT DOCUMENTS

| | | | | |
|---|---|---|---|---|
| D382,759 | S | 8/1997 | Adaska | |
| 5,662,268 | A | 9/1997 | Katzenberger | |
| 6,109,538 | A * | 8/2000 | Villani et al. | 239/33 |
| D439,787 | S | 4/2001 | Slater | |
| 6,264,114 | B1 | 7/2001 | Chow | |
| 2001/0042754 | A1 | 11/2001 | Lei | |
| 2002/0092919 | A1 | 7/2002 | Campagna | |
| 2002/0179729 | A1 | 12/2002 | Sheedy | |
| 2003/0006293 | A1 | 1/2003 | Lee | |
| 2003/0042324 | A1 | 3/2003 | Ho | |
| 2003/0087005 | A1 | 5/2003 | Baron | |
| 2003/0203075 | A1 | 10/2003 | Taylor | |
| 2003/0218076 | A1 | 11/2003 | Farnsworth et al. | |
| 2004/0069862 | A1 | 4/2004 | Sheedy | |
| 2004/0140314 | A1 * | 7/2004 | Li | 220/709 |

* cited by examiner

THERAPEUTIC TRAINING STRAW

FIELD OF THE INVENTION

The present invention relates to a drinking straw and more particularly to a therapeutic drinking straw for delivering liquids at an adjustable controlled rate to individuals who have the tendency to drink too fast or too much, for example so as to experience aspiration of liquid, or to individuals who may have swallowing difficulties.

BACKGROUND OF THE INVENTION

Children are known to play with their foods and drinks. While drinking beverages, children often, for various reasons, drink rapidly so as to cause aspiration of liquid, choking, gagging, or "brain freeze". In particular, children diagnosed with Attention Deficit/Hyperactivity Disorder (AD/HD) are likely to consume their drinks too quickly. AD/HD children are known to fidget with their hands or feet, to engage in physically dangerous activities without considering the possible consequences, to have difficulty playing quietly, and to have difficulty awaiting turns in games, conversations, and other activities. Other children may drink too fast because they are racing with other children or they are too impatient or they are trying to attract attention from peers or adults.

Difficulty in swallowing, leading to a decreased ability to move food and liquid from the mouth to the stomach, is referred to as dysphagia. A patient suffering from dysphagia may encounter medical complications, such as aspiration. Aspiration, wherein all or part of the bolus penetrates the airway below the level of the vocal folds, is commonly encountered by patients whose dysphagia results from cognitive impairment. Impairments in attention, judgement and memory may preclude such individuals from using safe swallowing techniques. Thus, while the motor skills for swallowing thin liquids may be present, the patient may not remember to take small sips or to appropriately monitor his rate of intake, resulting in aspiration.

Although conventional straws may be used to deliver liquids to children and dysphagic persons, they present problems since the rate or amount of liquid swallowed cannot be monitored or controlled. It has been determined that the risk of choking by dysphagic patients may be reduced by drinking with a chin-down head position. Accordingly, therapeutic drinking cups designed to promote such a chin-down head position have been developed and used. One such cup (a "Nosey Cup") includes a cut-out for the patient's nose so that the cup can be tipped to a drinking position with the chin down. A so-called "Dysphagia Cup" has also been developed, which is internally and externally contoured to promote drinking with a chin down head position. While these devices may prevent choking in dysphagic patients, they do not in any way control the rate or the amount of intake of the liquid.

One known therapeutic drinking straw machine consists of a straw with a pumping mechanism disposed between the two ends of the straw to convey liquid from the source to the mouth of the user. The pumping mechanism includes a manual actuator and a central reservoir such that the actuation of the actuator empties the reservoir and return of the actuator to a rest position re-fills the reservoir. This device allows a specific amount of liquid to be stored in the reservoir and then delivered to the user in order to assist motorically-impaired and cognitively-impaired individuals with swallowing difficulties.

However, the drinking straw machine is difficult and costly to manufacture since it requires a pump, reservoir, and valves. Furthermore, its bulkiness and overall design make the drinking straw machine unappealing, especially to children.

A novelty drinking straw is also known that has a decorative object positioned in the straw and between a pair of stops, which form a compartment. The object and the stops are dimensioned to prevent the movement of the object past the stops while allowing fluid to pass by. This device is designed only as a novelty to increase the attractiveness of the straw and to potentially use the decorative object for advertisement purposes. The object placed within the compartment is not used to block passage of liquid and may even dissolve or float. Novelty drinking straws are also known that are designed to be visually appealing to promote consumer purchases and child use.

Thus, while various straws have been developed to assist cognitive-impaired dysphagic patients or individuals with the tendency to drink rapidly, they are not entirely satisfactory.

SUMMARY OF THE INVENTION

The present invention relates to a drinking straw for regulating the amount of liquid that a user may drink in one sip. The present inventive straw has an elongated hollow member having at least two open ends, at least one end being a suction end adapted for application of a suction force and at least one end being a liquid end adapted for immersion in a liquid beverage. At least one compartment is associated with each suction end and is located between the associated suction end and the at least one liquid end, and the compartment has openings for communicating the liquid beverage therethrough. At least one insoluble object is disposed within the at least one compartment, the object having an outer diameter and/or circumference smaller than an inner diameter and/or circumference of the at least one compartment. The compartment openings and the object(s) are dimensioned to prevent escape of the object(s) from the compartment, and at least one object seals the compartment opening subsequent to the application of the suction force to prevent the movement of the liquid beverage past the opening.

In a preferred embodiment of the invention, the suction end of the drinking straw is further adapted for receipt in the mouth of a user, and may be even further adapted for receipt in the mouth of a user lacking normal mouth control. In another embodiment, the at least one suction end is further adapted to cooperate with a respirator mask to allow a user to use the straw while wearing the mask. The present invention also includes respirator mask in combination with the drinking straw, and may further include a flip top on the at least one suction end adapted for opening and closing the suction end by use of a user's tongue.

In another preferred embodiment of the invention, the at least one object seals the at least one compartment opening subsequent to the delivery of a specified volume of the liquid beverage through the suction end associated with that compartment. Preferably, the specified volume is between about 0.5 to about 50 ml. However, the specified volume may be about 1 to about 40 ml, about 5 to about 30 ml, about 5 to about 20 ml, or about 5 to about 15 ml. In these or in other embodiments, the specified volume is adjustable. The compartment may further include volume markings.

In a preferred embodiment of the invention, the object is a decorative object. Even more preferably, the at least one object does not float in air. In another preferred embodiment of the invention, the object has a density so as to be capable of traveling at a reasonable speed through air and most liquids and does not float in air. In some embodiments, the object has a density between about 1 and about 2 g/ml, about 1 to about 1.5 g/ml, about 1 to about 1.2 g/ml, or about 1 to about 1.1 g/ml. Generally, a density only slightly greater than that of water, or the liquid being drawn through the straw, is preferred.

In another preferred embodiment of the invention, the straw has two or more suction ends. Even more preferably, the at least one object within each of the at least one compartments associated with each suction end is capable of sealing both the compartment opening nearest the associated suction end and the compartment opening nearest the liquid end, but not both simultaneously. Preferably, a suction force applied to at least one suction end effectively seals the compartments associated with the remaining suction ends. In a different embodiment of the invention, the at least one object seals the at least one compartment opening only subsequent to the application of an excessive suction to the suction end associated with that compartment.

Preferably, the at least one compartment has a cross-sectional area substantially similar to a cross-sectional area of the hollow member. However, in a different embodiment, the at least one compartment has a cross-sectional area larger than a cross-sectional area of the hollow member. In a further embodiment, the at least one compartment has a cross-sectional area smaller than a cross-sectional area of the hollow member.

In a preferred embodiment of the invention, the straw is adapted to allow disassembly for cleaning, storage, and/or travel. Preferably, the straw includes male and female thread components for the disassembly and re-assembly of the straw. Screw threads associated with at least one of the compartments of the present invention allow for adjustment of the compartment volume. Both adjustable and non-adjustable embodiments of the invention may have volume markings on the exterior of the compartment, and adjustable versions may have graded volume markings to allow a user to accurately adjust the compartment to a selected volume.

The present invention also contemplates a method and/or a device for treating inappropriate drinking. The method and/or device employs a drinking straw as described above or below provided to a user in need of treatment that delivers the beverages in small, consistently-controlled quantities, and may include training the user to drink appropriately through repeated drinking of liquid through the straw until the user is trained to drink in small, consistent sips. The inappropriate drinking treatable using the present invention may be caused by AD/HD, dysphagia, intoxication, Alzheimer's disease, dementia, ALS, Parkinson's disease, muscular dystrophy, spinal cord injury, paralysis, multiple sclerosis, spasm, epilepsy, or other disease or condition that causes inappropriate drinking or any combination thereof.

The present invention also includes a method for preventing "brain freeze," the commonly-presented headache associated with over-consumption of ice-cold foods and beverages. The inventive method provides for drinking cold beverages through the straw as described above or below that delivers the beverages in small, consistently-controlled quantities, these quantities being less than the quantity required to cause a headache.

The present invention even further includes a drinking straw adapter for attachment to the end of a conventional drinking straw or tube. The adapter includes an elongated hollow member having at least two open ends, at least one end being a suction end adapted for application of a suction force, and at least one end being an adapter end adapted for communicative attachment to a drinking straw; at least one compartment associated with each at least one suction end and located between the associated at least one suction end and the at least one adapter end and having openings for communicating the liquid beverage therethrough; and at least one insoluble object within the at least one compartment having an outer diameter and/or circumference smaller than an inner diameter and/or circumference of the at least one compartment; wherein the compartment openings and the object are dimensioned to prevent escape of the object(s) from the compartment; and wherein the at least one object seals at least one compartment opening subsequent to the application of the suction force to prevent the movement of the liquid beverage past the opening.

DETAILED DESCRIPTION OF THE INVENTION

Figure 2:
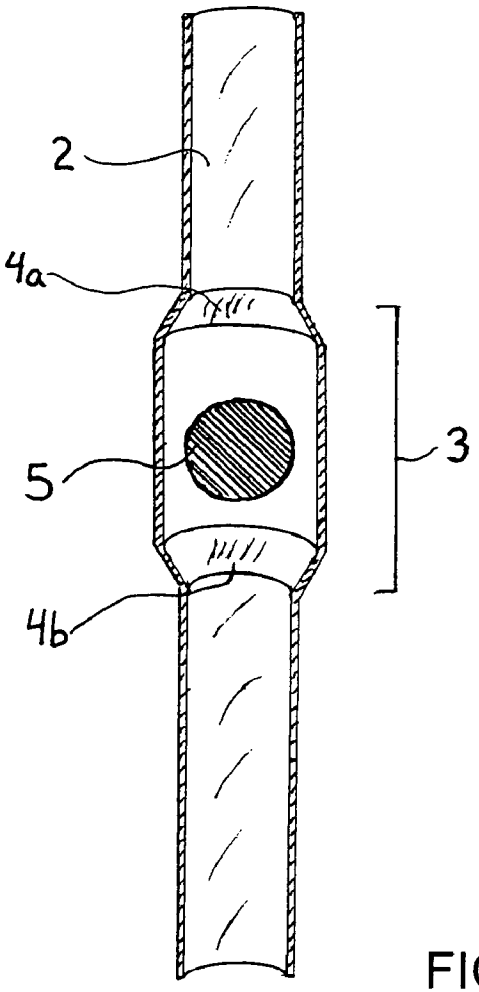
FIG. 2. shows a cross-sectional view of one embodiment of the present invention.

While the invention will be described with reference to the preferred embodiments, it will be obvious to those of ordinary skill in the art that variations of these preferred embodiments may be used, and it is intended that the invention may be practiced otherwise than as specifically described herein. Accordingly this invention includes all modifications and equivalents encompassed within the spirit and scope of the invention as defined by the written description and appended claims.

The therapeutic drinking straw according to this invention is designed to controllably deliver a repeatable quantity of liquid to dysphagic patients or other users. The patients or users may be dysphagic for any number of reasons; generally the reason is a medical reason. The symptoms of the dysphagia may comprise various abnormal behaviors. Common behaviors include excessive suction force, excessive suction duration, rapidly repeated suction, and impeded ability to swallow.

An excessive suction force is suction force beyond that amount required to draw fluid up through a drinking straw. Drinking with excessive suction force may result in fluid being aspirated into the lungs, gagging and/or choking the user. Excessive suction duration is suction duration beyond that required to draw an appropriate mouthful of liquid through a straw. Excessive suction duration may result in choking due to an inappropriately large volume of fluid being present in the mouth. Rapidly repeated suction occurs when the user sucks a second volume of liquid through the straw and into the mouth prior to swallowing the previous mouthful of liquid; this can result in choking. Any user with an impeded ability to swallow must take smaller than normal mouthfuls so as to be able to swallow without difficulty. A user with impeded ability to swallow has an elevated risk of choking at all times.

As is described more fully below, the present invention overcomes those problems noted above, as well as other problems known in the art, by preventing excessive suction and/or limiting the volume that may be drawn through the straw in a single suction event (i.e., a single breath).

The candidate patients or users will typically lack normal mouth control. Persons lacking normal mouth control generally lack the ability to normally control the tongue, lips, and/or jaw so as to consequently lack the ability to hold a drinking straw in their mouth, maintain or create suction around a drinking straw, and/or to effectively manipulate a drinking straw with their mouth. In such a case, the present invention may be provided with, or manufactured to include, an adapter to aid the user in these actions. Examples of such an adapter include a flexible hook or clip for attaching the straw to the user's mouth, a radial flange or disk around the circumference of the drinking straw to act as a gasket for creating and maintaining suction, a cushioned bulge in the straw that assists a user in holding the straw in his mouth by providing an improved mouth-grasping area, a mask having a hole with the straw inserted therethrough, and others known in the art.

Figure 7:
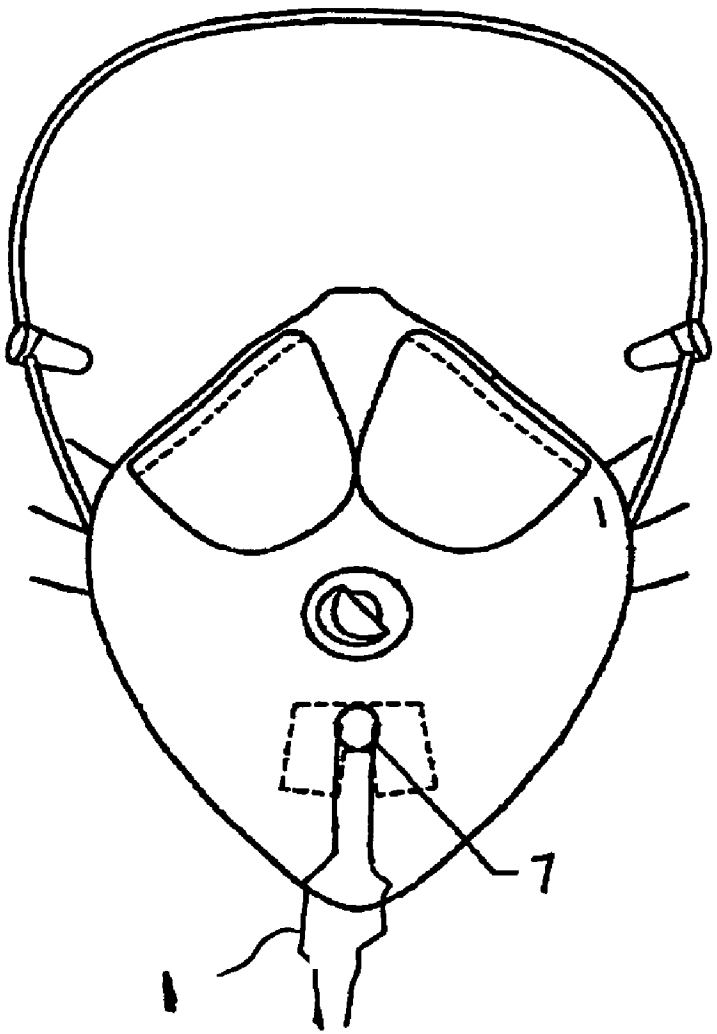
FIG. 7 shows a perspective view of one embodiment of the present invention in combination with a respirator.
Figure 8:
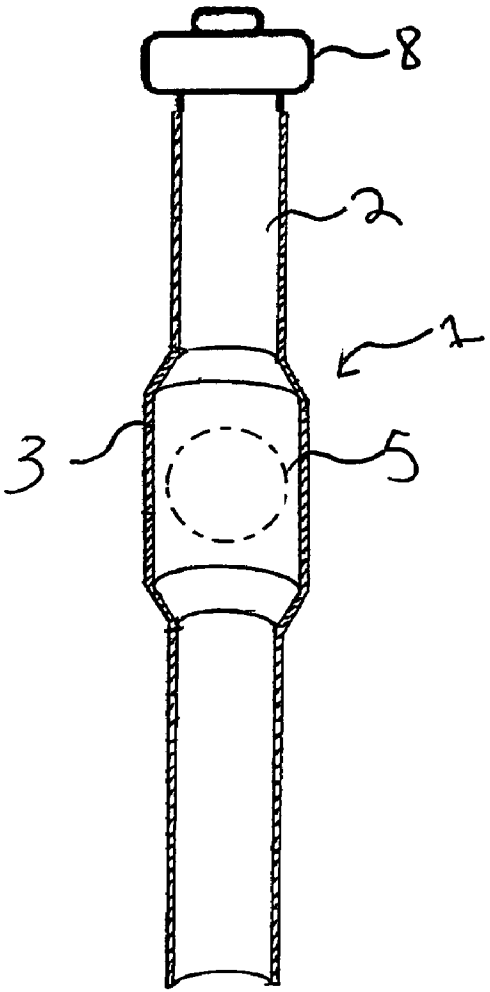
FIG. 8 shows a perspective partial view of one embodiment of the present invention.

The present invention may be combined with a respirator mask so as to make drinking convenient for patients required to wear a respirator mask, such as that shown by example in FIG. 7. The straw may be inserted through a hole (7) in the mask or made integral with and protruding through the mask. While the compartment is generally disposed distal to the patient, the compartment may also be disposed on the proximal side of the mask or across the thickness of the mask. The present invention may also include a flip top covering (8) that can be opened by a patient with his tongue, as shown in exemplary FIG. 8.

Figure 1:
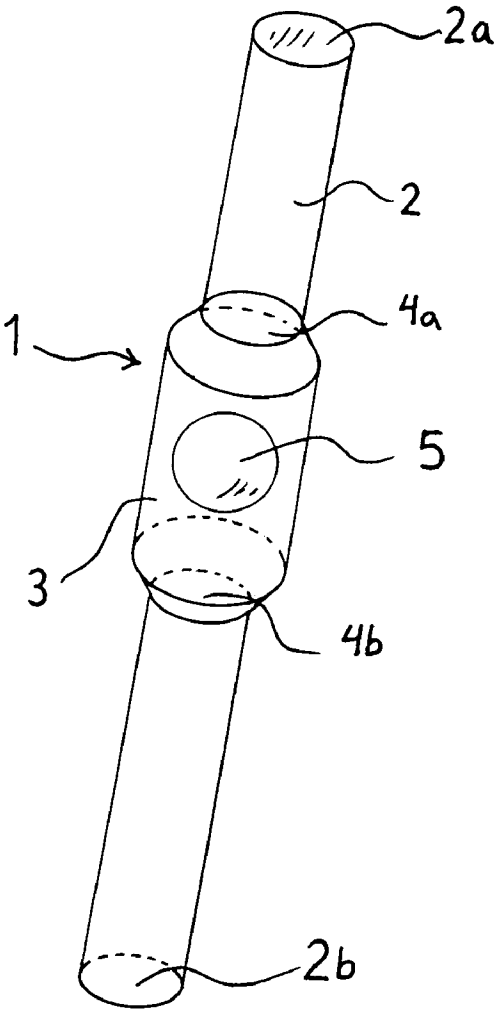
FIG. 1 shows a perspective view of one embodiment of the present invention.

In one embodiment, an example of which is shown in FIG. 1 and FIG. 2, the present invention is a drinking straw (1) that includes a drinking tube (2) with first and second axially extending end portions(2*a*, 2*b*) with an end used as a mouthpiece and another end used as a liquid pick up region. Preferably, the straw is axially symmetrical so that either end can be used as a mouthpiece or pick up region. In between the end openings, there is a compartment (3) created by two stop regions (4*a*, 4*b*) for controlling the amount of fluid desired for administration. An insoluble object (5) made of material non-toxic to the straw-user is disposed within the compartment and dimensioned to substantially prevent movement of the object past the stop regions. The stop regions are generally referred to as "upper" and "lower" stops based on their orientation relative to the user. The upper stop (4*a*) is closer to the end upon which the user applies suction force (2*a*); the lower stop (4*b*) is further from that end. The stop regions may also be referred to as the proximal and distal stops, respectively.

When the straw is not in use, the object will fall by gravitational force away from the upper stop. The object may or may not fall sufficiently to close the lower stop. When suction force is applied at one end of the drinking straw, such as by sucking on that end, the object will be drawn to the stop proximate to that end. While the object is traveling from the lower stop to the upper stop, the liquid will travel continuously from the distal end of the straw to the user's end. However, as soon as the object travels to the upper stop, it completely blocks the stop so as to prevent any more liquid from being administered to the user. This limits the amount that may be consumed by the user at one time. As the suction force is released, the object drops/falls away from the upper stop toward the lower stop.

Figure 6:
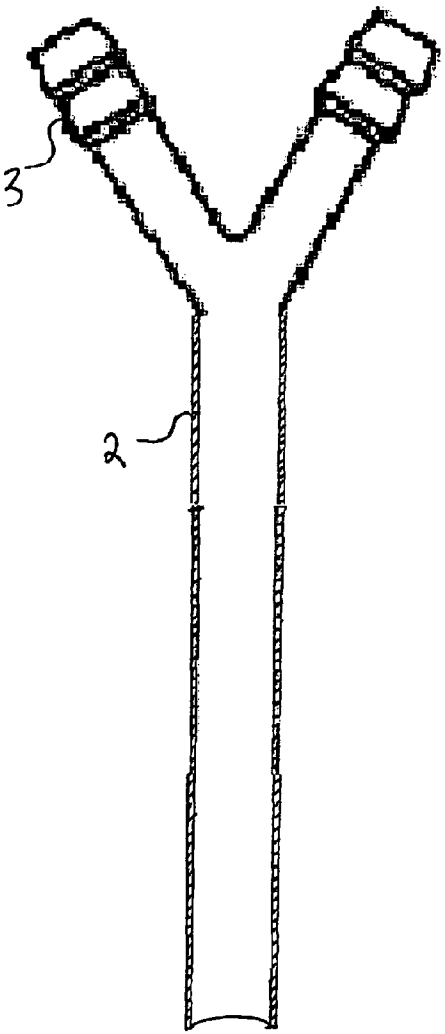
FIG. 6 shows a perspective view of one embodiment of the present invention.

In a different embodiment, the straw may have more than one suction end. For example, as shown in exemplary FIG. 6, it may have two suction ends and be generally Y-shaped. In such an embodiment, each suction end will have at least one compartment associated with it, for example on the two arms of the "Y." The lower, or liquid, end of each compartment will be adapted, like the suction end, so that the insoluble object(s) in each compartment will be effective to seal the lower end of the compartment when reverse suction force is applied, for example to seal the lower end of the left compartment when a user is sucking on the right suction end of the Y-shape. This will have the effect of preventing the intake of air (i.e., loss of vacuum) through the unused end or ends of the straw so that a single user is able to drink through a multi-headed straw.

Figure 4:
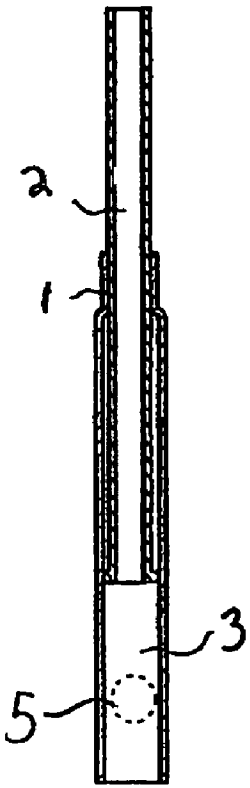
FIG. 4 shows a perspective partial view of one embodiment of the present invention wherein the specified volume is adjustable.
Figure 3:
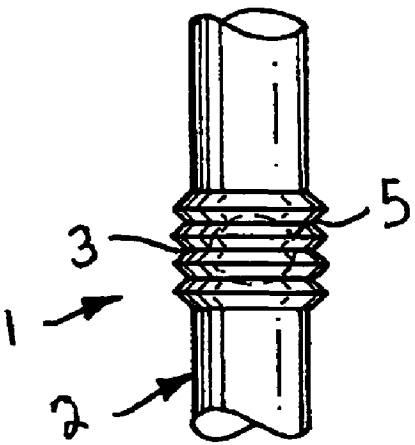
FIG. 3. shows a perspective partial view of one embodiment of the present invention wherein the specified volume is adjustable.
Figure 5:
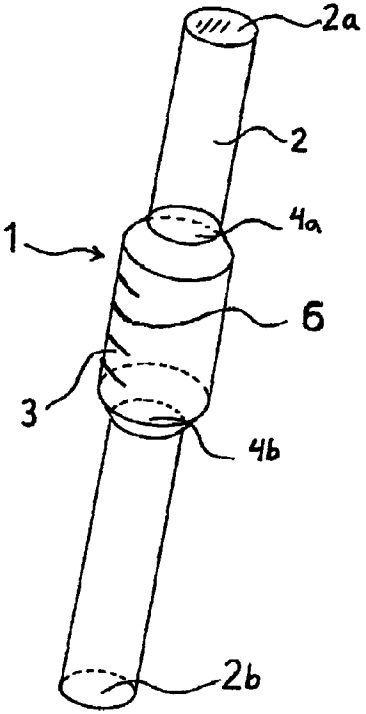
FIG. 5 shows a perspective view of one embodiment of the present invention.
Figure 9:
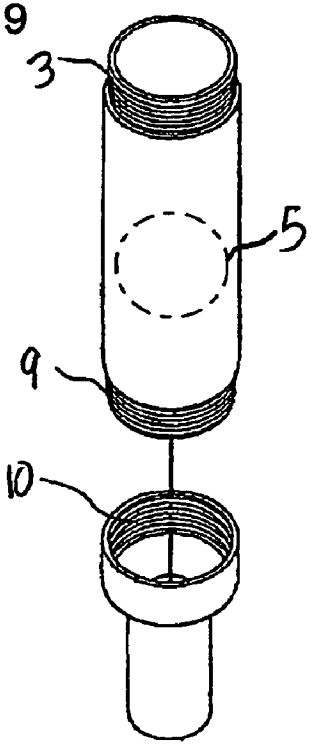
FIG. 9 shows a perspective partial view of one embodiment of the present invention.

Preferably the compartment is size-adjustable. One example of the compartment uses material that is flexible enough to stretch or compress yet rigid enough to retain its stretched or compressed shape. One way this may be accomplished is through the use of an accordion-shaped compartment, such as shown by example in FIG. 3. Another example is a threaded compartment (9) that may be adjusted in volume by screwing a portion of the compartment inward or outward in relation to another portion of the compartment (10), such as shown by example in FIG. 9. In this embodiment, the straw may be adapted to allow disassembly for cleaning, storage, and/or travel. An even further method employs a plunger-type apparatus, such as shown by example in FIG. 4. The compartment may further include volume markings (6), as shown in FIG. 5.

Preferably the object is of such density as to rise and fall at reasonable speeds through most liquids and the air. This way, the user would only have to wait a reasonable period of time before drinking again. A reasonable time is the amount of time a healthy patient requires to swallow a mouthful of liquid and take a breath. Preferably, the travel speed of the object is at a rate so as to ensure safety of the user, taking into account the maximum size of the adjustable compartment so that an impatient user would not experience aspiration by quick release-suction movements and/or overly-rapid repeated suction.

The above qualifications are preferably achieved by regulating the density of the object. Preferably, the object is denser than water. However, the object should not be so dense as to fall to the bottom of the compartment too rapidly or so as not to be able to be drawn up to the top of the compartment quickly enough during a suction event. Appropriate densities typically are between about 1 and about 2 g/ml, about 1 to about 1.5 g/ml, about 1 to about 1.2 g/ml, or about 1 to about 1.1 g/ml. Generally, a density only slightly greater than that of water, or the liquid being drawn through the straw, is preferable. Generally, it is not desirable for the object to float in the liquid as this may result in the compartment being blocked off prior to a sufficient volume of liquid being drawn through the straw. It may or may not be preferable for the object to sink in the liquid, depending upon whether or not the embodiment contemplates the compartment being sealed at its distal end when no suction force is being applied.

Preferably, the object and the compartment can be decoratively shaped or finished to attract consumers, particularly children. The object may be brightly colored, have flecks or speckles of color or glitter, be translucent, be decoratively shaped, have writing or pictures, and the like as is well known in the art. One preferred decorative shape is the ovoid shape of an American football. One preferred decorative coloring or pattern is the hexagonal block pattern as seen on a soccer ball. Another is a stitched pattern as seen on a baseball.

The drinking straw may be constructed using techniques and materials well known in the art. Preferably, the straw is made from polyurethane. The grade, quality, and thickness of the material will be according to standards well known in the art. The straw may be constructed of a lighter grade or thickness of material for a disposable application, but may also be made of a heavier grade or thickness for a multi-use application. Such a straw would be made of material sufficiently durable to withstand repeated washing in an automated washing machine, or of an even greater durability sufficient to withstand autoclaving.

The straw may also be made from biodegradable materials, such as waxed papers, for disposable one-time use. In such a case, the straw, or the straw's packaging, should be labeled with instructions stating that the straw should be discarded after one use.

The present invention may be combined with existing delivery devices or drink containers to enhance those products. The present invention contemplates an adapter that may be attached to the suction end of a conventional drinking straw, the top of a covered cup, or even the lip of a conventional cup. Such an embodiment will preferably be small in size to allow for convenient transport of the device. It may be packaged for individual, disposable use, and made of light-weight material, or it may be constructed of heavier grade material for re-use. A user may carry such an adapter in his pocket for use as needed without the inconvenience of carrying a full-length straw.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting. Likewise, not every embodiment of the invention need achieve every advantage disclosed above for any particular preferred embodiment.

The invention claimed is:

1. A drinking straw, comprising:

an elongated hollow member having at least two open ends, at least one end being a suction end adapted for application of a suction force, and at least one end being a liquid end adapted for immersion in a liquid beverage;

at least one compartment associated with the at least one suction end and located between the associated at least one suction end and the at least one liquid end and having an upper stop proximate the at least one suction end and a lower stop proximate the at least one liquid end, each stop defining a compartment opening for communicating the liquid beverage therethrough; and at least one insoluble object within the at least one compartment having an outer circumference smaller than an inner circumference of the at least one compartment;

wherein the compartment openings and the object are dimensioned to prevent escape of the object from the compartment; and wherein the at least one object seals the upper stop subsequent to the application of the suction force to prevent the movement of the liquid beverage past the upper stop.

2. The drinking straw of claim 1, wherein the suction end is further adapted for receipt in the mouth of a user.

3. The drinking straw of claim 2, wherein the suction end is further adapted for receipt in the mouth of a user lacking normal mouth control.

4. The drinking straw of claim 1, wherein the at least one object seals the upper stop subsequent to the delivery of a specified volume of the liquid beverage through the suction end associated with that compartment.

5. The drinking straw of claim 4, wherein the specified volume is between about 0.5 to about 50 ml.

6. The drinking straw of claim 4, wherein the specified volume is adjustable.

7. The drinking straw of claim 6, wherein the at least one compartment further comprises volume markings.

8. The drinking straw of claim 1, wherein the object is a decorative object.

9. The drinking straw of claim 1, comprising two or more suction ends.

10. The drinking straw of claim 9, wherein there is at least one compartment associated with each of the two or more suction ends and each of the at least one compartments is located between the associated two or more suction ends and the at least one liquid end and having an upper stop proximate the at least one suction end and a lower stop proximate the at least one liquid end, each stop defining a compartment opening for communicating the liquid beverage therethrough.

11. The drinking straw of claim 10, wherein a normal suction force applied to at least one suction end effectively seals the at least one compartments associated with the remaining suction ends.

12. The drinking straw of claim 1, wherein the at least one object does not float in air or water.

13. The drinking straw of claim 12, wherein the object has a density greater than or equal to the density of water.

14. The drinking straw of claim 13, wherein the object has a density between about 1 and about 1.5 g/ml.

15. The drinking straw of claim 1, wherein the at least one object seals the upper stop only subsequent to the application of an excessive suction to the suction end associated with that compartment.

16. The drinking straw of claim 1, wherein the at least one compartment has a cross-sectional area substantially similar to a cross-sectional area of the hollow member.

17. The drinking straw of claim 1, wherein the at least one compartment has a cross-sectional area larger than a cross-sectional area of the hollow member.

18. The drinking straw of claim 1, wherein the at least one suction end is further adapted to cooperate with a respirator mask to allow a user to use the straw while wearing the mask.

19. A respirator mask comprising the drinking straw of claim 18.

20. The drinking straw of claim 18, further comprising a flip top on the at least one suction end adapted for opening and closing the suction end by use of a user's tongue.

21. The drinking straw of claim 1, further adapted to allow disassembly for cleaning.

22. A method for treating inappropriate drinking, comprising:

providing to a user in need of treatment a drinking straw that delivers beverages in small, consistently-controlled quantities, the straw comprising:

an elongated hollow member having at least two open ends, at least one end being a suction end adapted for application of a suction force, and at least one end being a liquid end adapted for immersion in a liquid beverage;

at least one compartment associated with the at least one suction end and located between the associated at least one suction end and the at least one liquid end and having an upper stop proximate the at least one suction end and a lower stop proximate the at least one liquid end, each stop defining an opening for communicating the liquid beverage therethrough; and at least one insoluble object within the at least one compartment having an outer circumference smaller than an inner circumference of the at least one compartment;

wherein the at least one compartment and the at least one insoluble object are dimensioned to prevent escape of the at least one insoluble object from the at least one compartment; and wherein the at least one insoluble object seals the upper stop subsequent to the application of the suction force to prevent the movement of the liquid beverage past the upper stop opening; and the user drinking the liquid through the straw.

23. The method of claim 22, wherein the inappropriate drinking is caused by AD/HD, dysphagia, intoxication, Alzheimer's disease, dementia, ALS, Parkinson's disease, muscular dystrophy, spinal cord injury, paralysis, multiple sclerosis, spasm, epilepsy, or other disease or condition that causes inappropriate drinking or any combination thereof.

24. The method of claim 23, further comprising:

training the user to drink in small, controlled sips by repeatedly drinking beverages through the straw until the user is trained to drink in small, consistent sips.

25. A device for treating inappropriate drinking, comprising:

an elongated hollow member having at least two open ends, at least one end being a suction end adapted for application of a suction force, and at least one end being a liquid end adapted for immersion in a liquid beverage;

at least one compartment associated with the at least one suction end and located between the associated at least one suction end and the at least one liquid end and having an upper stop proximate the at least one suction end and a lower stop proximate the at least one liquid end, each stop defining an opening for communicating the liquid beverage therethrough; and at least one insoluble object within the at least one compartment having an outer circumference smaller than an inner circumference of the at least one compartment;

wherein the at least one compartment and the at least one insoluble object are dimensioned to prevent escape of the at least one insoluble object from the at least one compartment, and wherein the at least one insoluble object seals the upper stop subsequent to the application of the suction force to prevent the movement of the liquid beverage past the upper stop opening.

26. The device of claim 25, wherein the inappropriate drinking is caused by one or more of AD/HD, dysphagia, intoxication, Alzheimer's disease, dementia, ALS, Parkinson's disease, muscular dystrophy, spinal cord injury, paralysis, multiple sclerosis, spasm, epilepsy, or other disease or condition that causes inappropriate drinking or any combination thereof.

27. A drinking straw adapter, comprising:

an elongated hollow member having at least two open ends, at least one end being a suction end adapted for application of a suction force, and at least one end being an adapter end adapted for communicative attachment to a drinking straw;

at least one compartment associated with each at least one suction end and located between the associated at least one suction end and the at least one adapter end and having an upper stop proximate the at least one suction end and a lower stop proximate the at least one liquid end, each stop defining an opening for communicating the liquid beverage therethrough; and at least one insoluble object within the at least one compartment having an outer circumference smaller than an inner circumference of the at least one compartment;

wherein the at least one compartment and the at least one insoluble object are dimensioned to prevent escape of the at least one insoluble object from the at least one compartment; and wherein the at least one insoluble object seals the upper stop subsequent to the application of the suction force to prevent the movement of the liquid beverage past the upper stop opening.

* * * * *